US009444211B2

(12) United States Patent
Tsai

(10) Patent No.: US 9,444,211 B2
(45) Date of Patent: Sep. 13, 2016

(54) CRIMPING CLAMP

(71) Applicant: HANLONG INDUSTRIAL CO., LTD., New Taipei (TW)

(72) Inventor: Yi-Hung Tsai, New Taipei (TW)

(73) Assignee: Hanlong Industrial Co. Ltd., New Taipei (TW)

( * ) Notice: Subject to any disclaimer, the term of this patent is extended or adjusted under 35 U.S.C. 154(b) by 0 days.

(21) Appl. No.: 14/666,350

(22) Filed: Mar. 24, 2015

(65) Prior Publication Data

US 2016/0218474 A1 Jul. 28, 2016

(30) Foreign Application Priority Data

Jan. 23, 2015 (TW) ..... 104201086 U

(51) Int. Cl.
*B21D 37/14* (2006.01)
*H01R 43/042* (2006.01)
*B25B 7/12* (2006.01)

(52) U.S. Cl.
CPC ..... *H01R 43/042* (2013.01); *B21D 37/14* (2013.01); *B25B 7/12* (2013.01)

(58) Field of Classification Search
CPC .... H01R 43/042; B21D 37/10; B21D 37/14; B25B 7/12
USPC ..... 72/409.16
See application file for complete search history.

(56) References Cited

U.S. PATENT DOCUMENTS 1,809,823 A * 6/1931 Altvater ..... B21D 28/34 279/76
4,292,833 A * 10/1981 Lapp ..... H02G 1/00 72/409.01
4,688,459 A * 8/1987 Osborn ..... B21D 28/36 279/97
7,762,117 B2 * 7/2010 Faucher ..... B25B 27/10 403/14
8,069,700 B2 * 12/2011 Liao ..... B25B 7/12 29/750
8,746,703 B2 * 6/2014 Xu ..... B25B 23/0035 279/76
9,166,353 B1 * 10/2015 Doornbos ..... H01R 43/048
2009/0308132 A1 * 12/2009 Lai ..... H01R 43/042 72/409.16

* cited by examiner

*Primary Examiner* — David B Jones
(74) *Attorney, Agent, or Firm* — Alan D. Kamrath; Kamrath IP Lawfirm, P.A.

(57) ABSTRACT

A crimping clamp includes a pair of clamp bodies, a pair of jaws and a pair of lock mechanisms. A head end of the clamp body includes a containing groove, a pair of perforations and at least one opening. The perforations are respectively disposed at two corresponding sides of the containing groove and correspond to each other. Each of the jaws includes a hole. When each of the jaws is combined in each containing groove, each hole corresponds to one of the openings. Each of the lock mechanisms includes a bolt, a rod and an operating lever. The bolt is movably inserted in the opening. One end of the rod is connected with one end of the bolt. The operating lever is movably inserted in the perforation, and one end of the operating lever is connected with the other end of the rod.

8 Claims, 4 Drawing Sheets

CRIMPING CLAMP

BACKGROUND OF THE INVENTION

1. Field of the Invention

The present invention relates to a crimping clamp. More particularly, the present invention relates to a crimping clamp designed such that the user can quickly replace the jaw.

2. Description of the Related Art

There are many types of end connectors for connecting to one end of a wire. Therefore, a shape of a crimping groove of a tool for crimping the end of a wire and an end connector must be diverse to fit the shapes of different end connectors. The current crimping clamp on the market is designed such that the jaw can be changed according to the requirement of the user.

However, the clamp body and the jaw of the crimping clamp with a replaceable jaw are combined via a screw locking method. Therefore, when the user wants to replace the jaw, the user must use a screwdriver to remove the screw for replacing the jaw, which is not convenient for the user.

SUMMARY OF THE INVENTION

It is a primary object of the present invention to provide a crimping clamp for allowing the user to change the jaw quickly.

To achieve the above object, the crimping clamp of the present invention includes a pair of clamp bodies, a pair of jaws and a pair of lock mechanisms. Each of the clamp bodies includes a holder end and a head end. The head end is connected with the holder end and includes a containing groove, a pair of perforations and at least one opening. The pair of perforations is respectively disposed at two corresponding sides of the containing groove and substantially corresponds to each other. The at least one opening communicates with the containing groove. Each of the jaws is demountably combined in the containing groove of the head end of each of the clamp bodies, and each of the jaws respectively includes a hole. When each of the jaws is respectively combined in each of the containing grooves, each of the holes corresponds to each of the openings. Each of the lock mechanisms includes a bolt, a rod and an operating lever. The bolt is movably inserted in the opening. One end of the rod is connected with one end of the bolt. The operating lever is movably inserted in the corresponding perforations, and one end of the operating lever is connected with the other end of the rod, such that the rod is moved by movement of the operating lever to cause the bolt to be inserted into the hole or withdrawn from the hole.

According to one embodiment of the present invention, the crimping clamp of the present invention further includes a pair of stoppers. Each of the stoppers is respectively connected to the one end of each of the operating levers which is not connected to the rod, and a width of each of the stoppers is greater than an aperture of at least one perforation of each of the pair of perforations.

According to one embodiment of the present invention, the crimping clamp of the present invention further includes a pair of elastic elements. The pair of elastic elements is respectively connected to each of the operating levers and located between each of the stoppers and the head end of each of the clamp bodies. Each of the elastic elements is used for respectively providing an elastic force to each of the operating levers.

According to one embodiment of the present invention, the crimping clamp of the present invention further includes a pair of first locking elements. Each of the first locking elements is used for combining each of the operating levers to each of the rods, respectively.

According to one embodiment of the present invention, the crimping clamp of the present invention further includes a pair of second locking elements. Each of the second locking elements is used for combining each of the bolts to each of the rods, respectively.

According to one embodiment of the present invention, the number of the at least one opening is two. The two openings are respectively disposed at two corresponding sides of the containing groove and substantially correspond to each other.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PREFERRED EMBODIMENT

Figure 1:
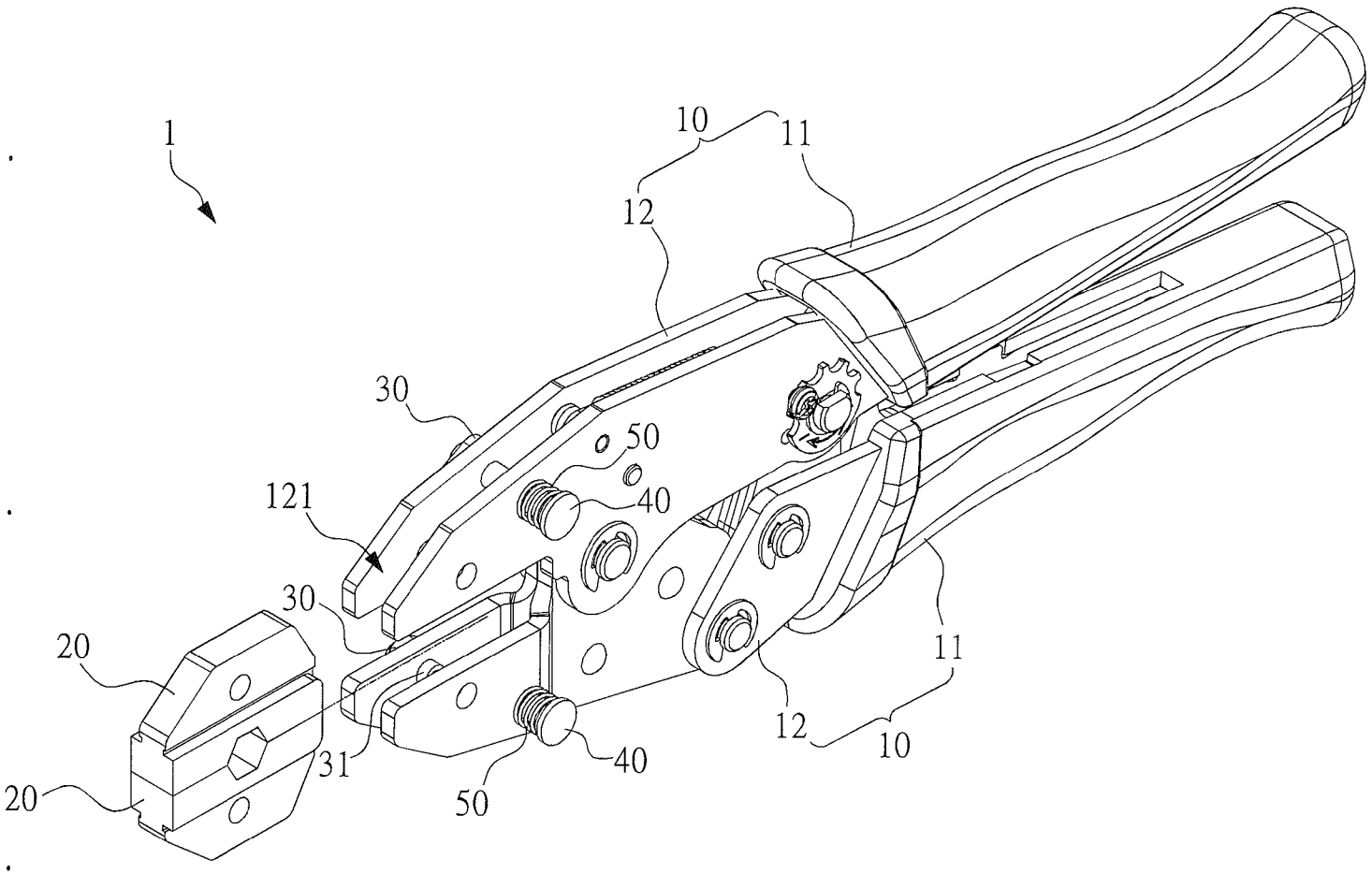
FIG. 1 is a side-top view of the crimping clamp of the present invention.
Figure 2:
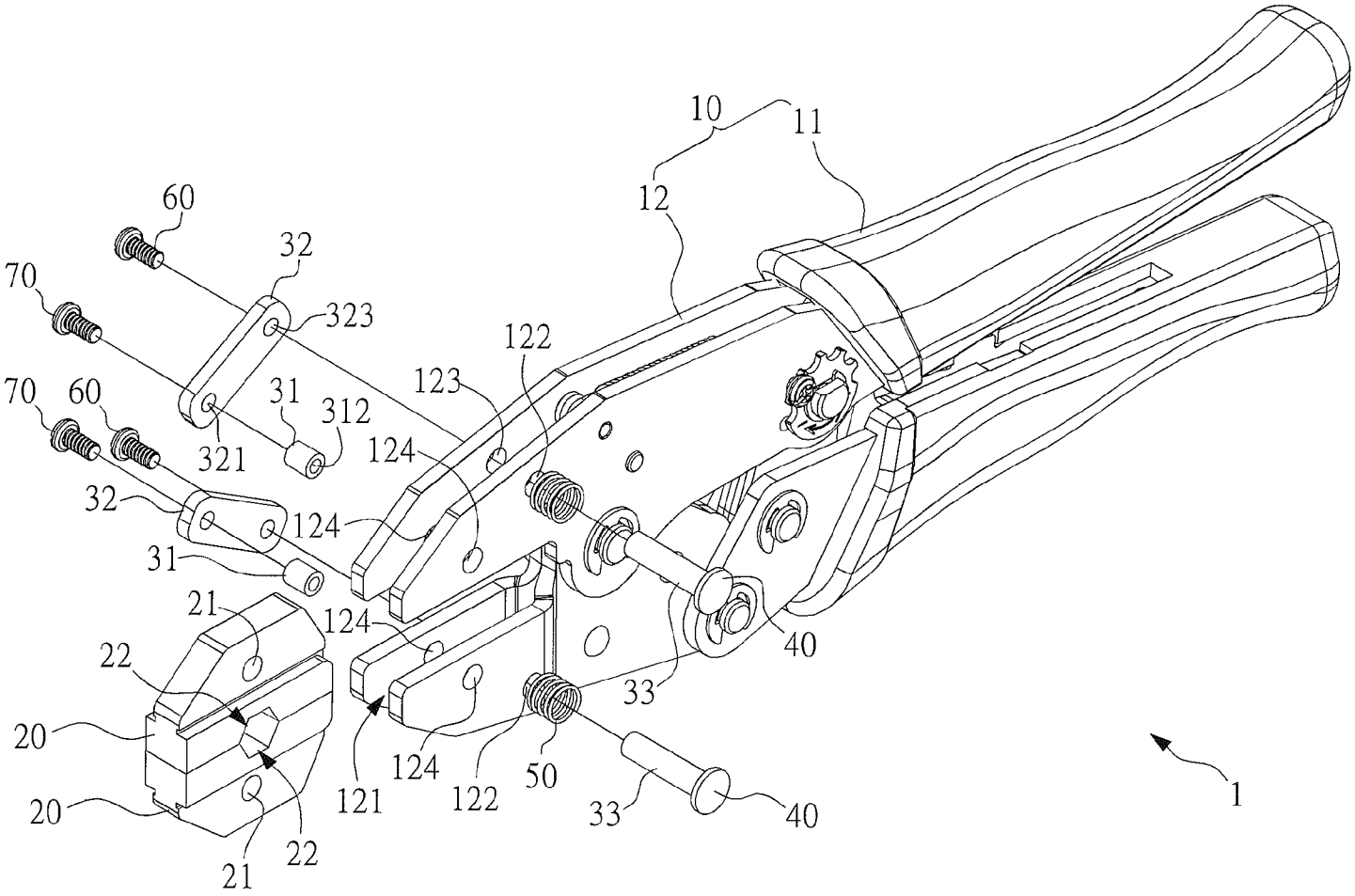
FIG. 2 is an exploded diagram of the crimping clamp of the present invention.

Please refer to FIG. 1 and FIG. 2 at the same time, which illustrate the structure of the crimping clamp of the present invention.

As shown in FIG. 1 and FIG. 2, in one embodiment of the present invention, the crimping clamp 1 of the present invention is used for crimping an end connector to one end of a wire (not shown in the figure). The crimping clamp 1 includes a pair of clamp bodies 10, a pair of jaws 20, a pair of lock mechanisms 30, a pair of stoppers 40, a pair of elastic elements 50, a pair of first locking elements 60 and a pair of second locking elements 70.

In one embodiment of the present invention, each of the clamp bodies 10 includes a holder end 11 and a head end 12. The head end 12 is connected with the holder end 11, and the head end 12 of each of the clamp bodies 10 includes a containing groove 121, a pair of perforations 122,123 and a pair of openings 124. The perforations 122,123 are respectively disposed at two corresponding sides of the containing groove 121 and communicate with the containing groove 121. The perforations 122,123 substantially correspond to each other, and an aperture of the perforations 122,123 could be the same or different. The openings 124 are also respectively disposed at two corresponding sides of the containing groove 121 and communicate with the containing groove 121. The openings 124 substantially correspond to each other. To be noted is that the number of the openings 124 can be only one. It is unnecessary that the number of the openings 124 be two or more.

In one embodiment of the present invention, each of the jaws 20 is demountably combined in the containing groove 121 of the head end 12 of each of the clamp bodies 10, and each of the jaws 20 respectively includes a hole 21 and a crimping notch 22. When each of the jaws 20 is respectively combined in each of the containing grooves 121, the hole 21 of each of the jaws 20 respectively corresponds to the opening 124 of the head end 12 of each of the clamp bodies 10. When each of the jaws 20 is respectively combined in each of the containing grooves 121, then via the clamping of the head ends 12 of the two clamp bodies 10, the crimping notch 22 of the two jaws 20 can be correspondingly combined to form a crimping groove, and the crimping groove can be used for crimping the wire and the end connector (not shown in the figure).

As shown in FIG. 2, in one embodiment of the present invention, each of the lock mechanisms 30 includes a bolt 31, a rod 32 and an operating lever 33. The bolt 31 is movably inserted in one of the openings 124. The two ends of the rod 32 respectively have inserting holes 321, 323, and one end of the rod 32 is connected to one end of the bolt 31. The operating lever 33 is movably inserted in the corresponding perforations 122,123, and one end of the operating lever 33 is connected to the one end of the rod 32 which is not connected to the bolt 31.

In one embodiment of the present invention, each of the stoppers 40 is respectively connected to one end of the operating lever 33 of each of the lock mechanisms 30 which is not connected to the rod 32. A width of each of the stoppers 40 is greater than an aperture of the perforations 122,123 or greater than the aperture of the perforation 122 but less than the aperture of the perforation 123. Each of the stoppers 40 is used for preventing the whole operating lever 33 from separating from each of the perforations 122,123 and separating from the clamp body 10.

In one embodiment of the present invention, each of the elastic elements 50 is respectively connected to the operating lever 33 of each of the lock mechanisms 30 and located between each of the stoppers 40 and the head end 12 of each of the clamp bodies 10. Each of the elastic elements 50 is used for respectively providing an elastic force to each of the operating levers 33, such that each of the operating levers 33 drives the one end of each of the bolts 31 which is not connected to the rod 32 to be inserted into the containing groove 121 of each of the head ends 12. In a specific embodiment of the present invention, the elastic elements 50 of the present invention are tension springs, but the present invention is not limited to that design.

In one embodiment of the present invention, each of the first locking elements 60 is respectively used for combining each of the operating levers 33 to each rod 32. In other words, one end of the operating lever 33 is connected to one end of the rod 32 by locking of the first locking elements 60. In a specific embodiment of the present invention, the first locking elements 60 are screws, and the operating lever 33 has a corresponding screw hole (not shown in the figure). The screw can be locked to the screw hole of the operating lever 33 after the screw passes through the inserting hole 323 of one end of the rod 32 to combine the operating lever 33 and the rod 32. To be noted is that the operating lever 33 and the rod 32 may be also integrally formed or be connected by another way. In other words, the first locking elements 60 may be omitted.

In one embodiment of the present invention, each of the second locking elements 70 is respectively used for combining each of the bolts 31 to each of the rods 32. In other words, one end of the bolt 31 is connected to the one end of the rod 32 which is not connected to the operating lever 33 by locking of the second locking element 70. In a specific embodiment of the present invention, the second locking elements 70 are also screws, and the bolt 31 has a corresponding screw hole 312. The screw can be locked to the screw hole 312 of the bolt 31 after the screw passes through the inserting hole 321 of one end of the rod 32 to combine the bolt 31 and the rod 32. To be similarly noted is that the bolt 31 and the rod 32 may also be integrally formed or be connected by another way, so the second locking elements 70 may be omitted.

Figure 3:
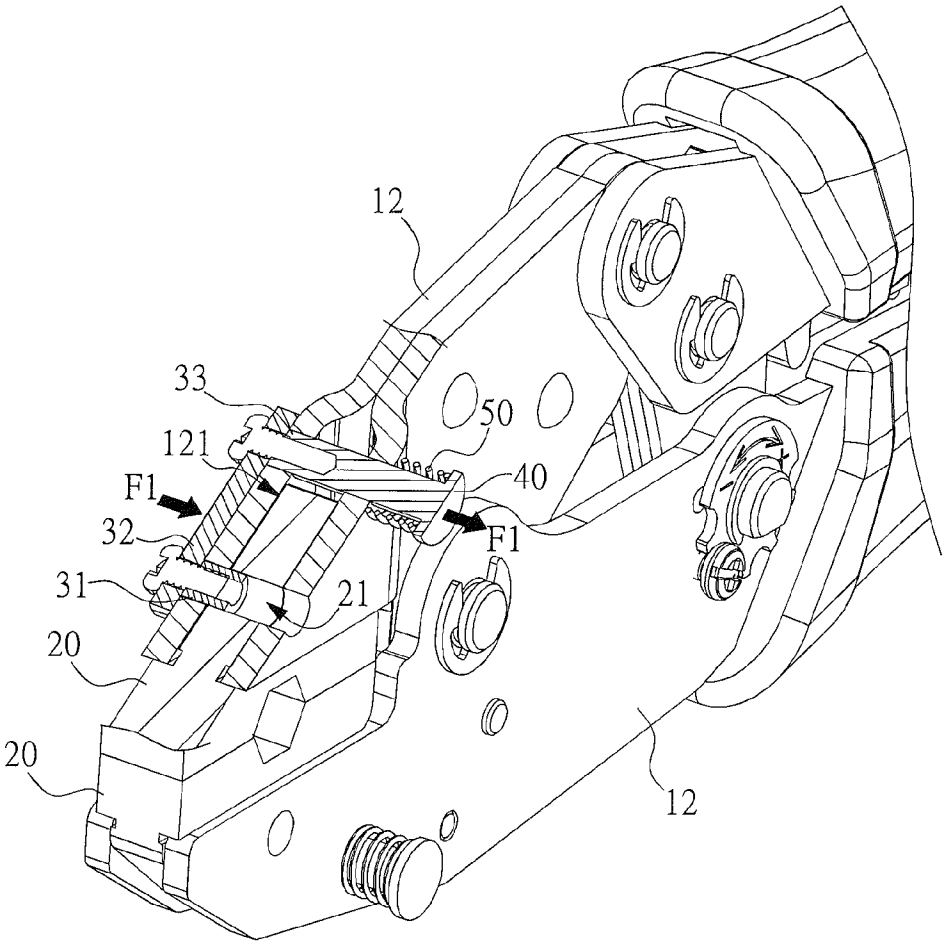
FIG. 3 illustrates a schematic drawing which shows the bolt of the lock mechanism inserted into the hole of the jaw.
Figure 4:
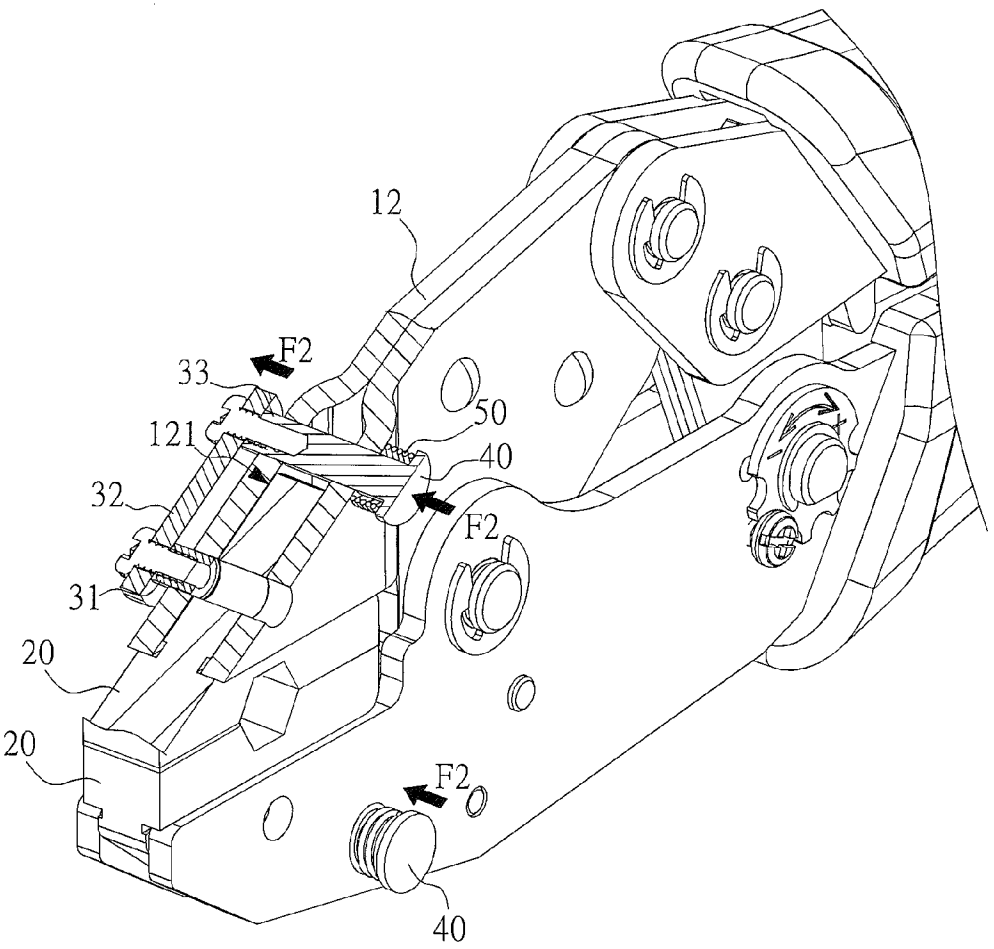
FIG. 4 illustrates a schematic drawing which shows the bolt of the lock mechanism not inserted into the hole of the jaw.

Finally, please refer to FIG. 2 to FIG. 4. FIG. 3 illustrates a schematic drawing which shows the bolt of the lock mechanism inserted into the hole of the jaw; and FIG. 4 illustrates a schematic drawing which shows the bolt of the lock mechanism not inserted into the hole of the jaw.

As shown in FIG. 3, when the jaw 20 is combined in the containing groove 121, the operating lever 33 of the lock mechanism 30 drives the rod 32 to move toward a side of the head end 12 (as shown by the arrow F1 in FIG. 3) because of the elastic force provided by the elastic elements 50, so the bolt 31 can be inserted into the hole 21 of the jaw 20. At this time, the jaw 20 is fastened in the containing groove 121 because of the locking of the bolt 31, such that a user does not remove the jaw 20 from the head end 12 of the clamp body 10. When the user wants to replace the jaw 20, the user presses the stoppers 40 with his/her fingers and pushes the operating lever 33 toward the elastic elements 50 (as shown by the arrow F2 in FIG. 4), such that the operating lever 33 will drive the rod 32 away from the side of the head end 12 and the bolt 31 will depart from the hole 21 of the jaw 20. At this time, the jaw 20 is not fastened by the bolt 31, so the jaw 20 can be removed from the containing groove 121.

Via the abovementioned description, the jaw 20 of the crimping clamp 1 of the present invention is fastened by the movable bolt 31, so there is no need to use any tool to assemble or disassemble the jaw 20, which can eliminate the inconvenience of using a screw to lock the jaw 20 of the crimping clamp 1.

In summary, regardless of the function, the method and result of the present invention are shown to have technical characteristics different from the prior arts, and said method and result constitute a significant advance in the field. However, the aforementioned embodiments are just for illustration of the principle and the result of the present invention and should not be construed to limit the range of the present invention. It will be obvious to those skilled in the art that, based upon the content herein, changes and modifications may be made without departing from the spirit and scope of the present invention. Therefore, the appended claims are intended to encompass within their scope all such changes and modifications as are within the true spirit and scope of the exemplary embodiment(s) of the present invention.

What is claimed is:

1. A crimping clamp comprising:

a pair of clamp bodies, with each of the pair of clamp bodies comprising:

a holder end; and a head end connected to the holder end, with the head end of each clamp body comprising a containing groove having two corresponding sides, a pair of perforations and an opening, wherein the pair of perforations is respectively disposed at the two corresponding sides of the containing groove, wherein the pair of perforations substantially corresponds to each other; wherein the opening communicates with the containing groove;

a pair of jaws demountably combined in the containing grooves of the head ends of the pair of clamp bodies, respectively, wherein each jaw comprises a hole; and wherein when the pair of jaws is respectively combined in the containing grooves of the pair of clamp bodies, the holes of the pair of jaws substantially correspond to the openings of the pair of clamp bodies; and a pair of lock mechanisms each comprising:

a bolt movably inserted in the opening;

a rod, with one end of the rod connected to one end of the bolt; and an operating lever movably inserted in one of the pair of perforations, wherein one end of the operating lever is connected to another end of the rod, such that the rod is moved by movement of the operating lever to cause the bolt to be inserted into the hole or withdrawn from the hole.

2. The crimping clamp as claimed in claim 1, further comprising a pair of stoppers respectively connected to the operating levers of the pair of lock mechanisms, wherein a width of each of the pair of stoppers is greater than an aperture of at least one perforation of the pair of perforations.

3. The crimping clamp as claimed in claim 2, further comprising a pair of elastic elements respectively connected to the operating levers of the pair of lock mechanisms and located between the pair of stoppers and the head ends of the pair of clamp bodies, with the pair of elastic elements respectively used for providing an elastic force to the operating levers of the pair of lock mechanisms.

4. The crimping clamp as claimed in claim 3, further comprising a pair of first locking elements combining the operating levers with the rods of the pair of lock mechanisms.

5. The crimping clamp as claimed in claim 4, further comprising a pair of second locking elements combining the bolts with the rods of the pair of lock mechanisms.

6. The crimping clamp as claimed in claim 5, wherein the head end further comprises a further opening, and wherein the opening and the further opening are respectively disposed at the two corresponding sides of the containing groove, wherein the opening and the further opening substantially correspond to each other.

7. The crimping clamp as claimed in claim 1, further comprising a pair of first locking elements combining the operating levers with the rods of the pair of lock mechanisms.

8. The crimping clamp as claimed in claim 1, wherein the head end further comprises a further opening, and wherein the opening and the further opening are respectively disposed at the two corresponding sides of the containing groove, wherein the opening and the further opening substantially correspond to each other.

* * * * *